United States Patent [19]

Gleason et al.

[11] Patent Number: 5,042,853

[45] Date of Patent: Aug. 27, 1991

[54] PADDLE LATCH ASSEMBLY

[75] Inventors: Stephen J. Gleason, Charles City; Marvin L. Larsen, New Hampton, both of Iowa

[73] Assignee: Tri-Mark, New Hampton, Iowa

[21] Appl. No.: 534,171

[22] Filed: Jun. 6, 1990

[51] Int. Cl.[5] ..... E05C 3/08

[52] U.S. Cl. ..... 292/126; 292/DIG. 31; 292/216

[58] Field of Search ..... 292/DIG. 31, 216, 99, 292/108, 210, 126, DIG. 14, 113

[56] References Cited

U.S. PATENT DOCUMENTS

| | | | |
|---|---|---|---|
| 961,780 | 6/1910 | Lauzon | 292/113 |
| 1,160,105 | 11/1915 | Bodenstein | 292/DIG. 14 |
| 2,793,061 | 5/1957 | Dall | 292/DIG. 14 |
| 3,338,610 | 8/1967 | Pelcin et al. | 292/126 |
| 3,397,906 | 8/1968 | Beckman et al. | 292/108 |
| 3,782,141 | 1/1974 | Doerrfeld | 292/DIG. 31 |
| 4,438,964 | 3/1984 | Peters | 292/216 |
| 4,441,345 | 4/1984 | Guarr | 292/DIG. 14 |
| 4,892,338 | 1/1990 | Weinerman et al. | 292/35 |
| 4,911,487 | 3/1990 | Rachocki | 292/216 |

FOREIGN PATENT DOCUMENTS

| | | | |
|---|---|---|---|
| 2202897A | 10/1988 | United Kingdom | 292/DIG. 32 |

*Primary Examiner*—Eric K. Nicholson
*Assistant Examiner*—Darnell M. Boucher
*Attorney, Agent, or Firm*—Wood, Phillips, Mason, Recktenwald & VanSanten

[57] ABSTRACT

A latch assembly for releasably securing a closure element with a striker element in a closed position. The latch assembly consists of a housing with a body, a release lever mounted for movement relative to the housing between (a) a normal position and (b) a release position; first and second latch elements mounted to the housing for movement relative to each other and the housing, with the first latch element being movable relative to the housing between a latched position in which it maintains the closure in its closed position and a release position in which the closure can be moved out of its closed position, and cooperating structure on the release lever and first and second latch elements for moving the second latch element relative to the housing and, in response thereto, causing the first latch element to move from its latched position to its release position as an incident of the release lever moving from its normal position to its release position.

18 Claims, 2 Drawing Sheets

Fig. 1
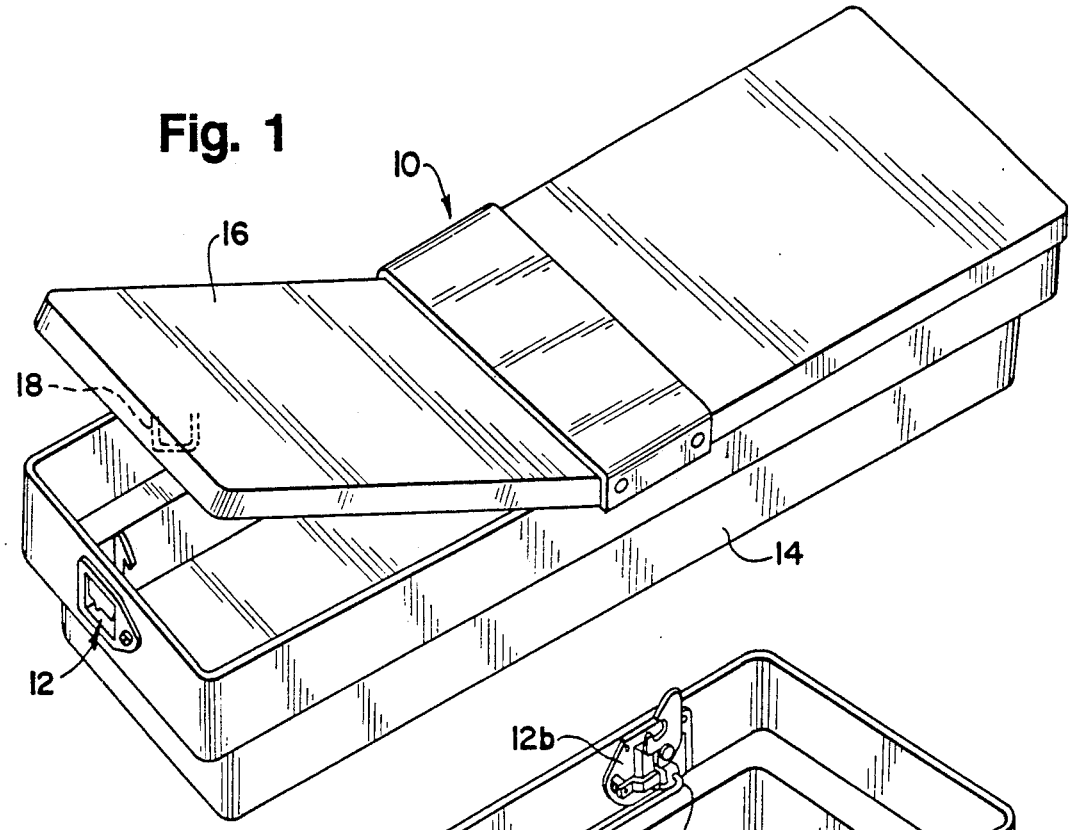
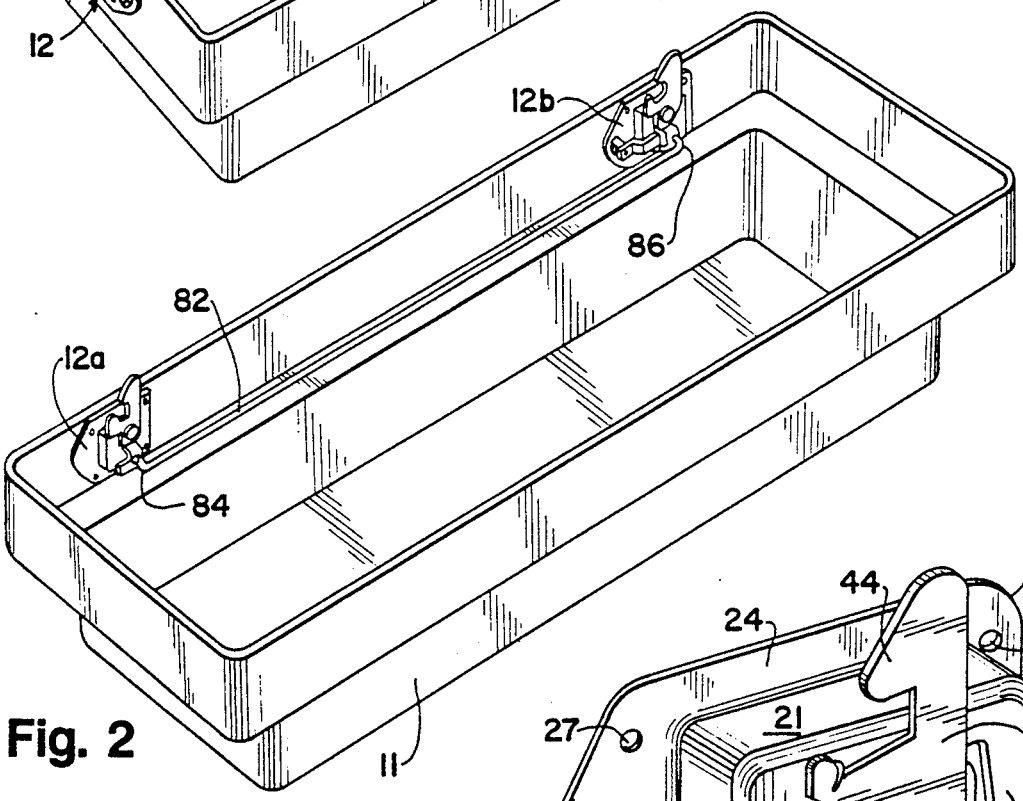
Fig. 2
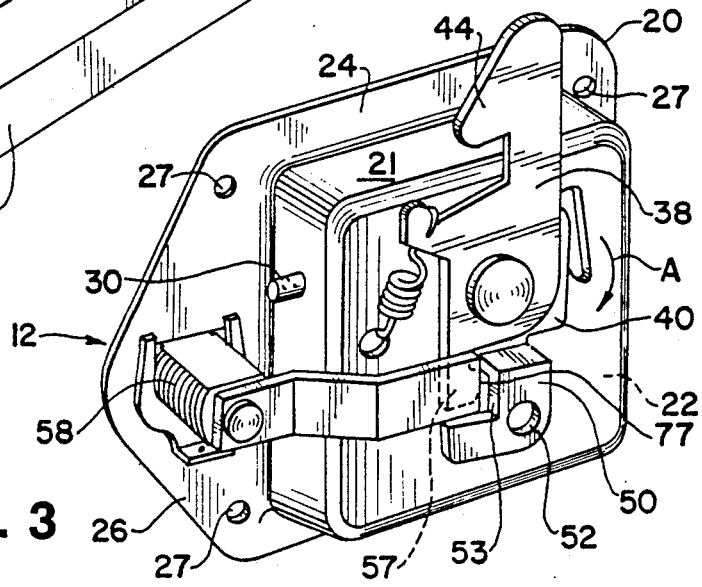
Fig. 3

Fig. 4
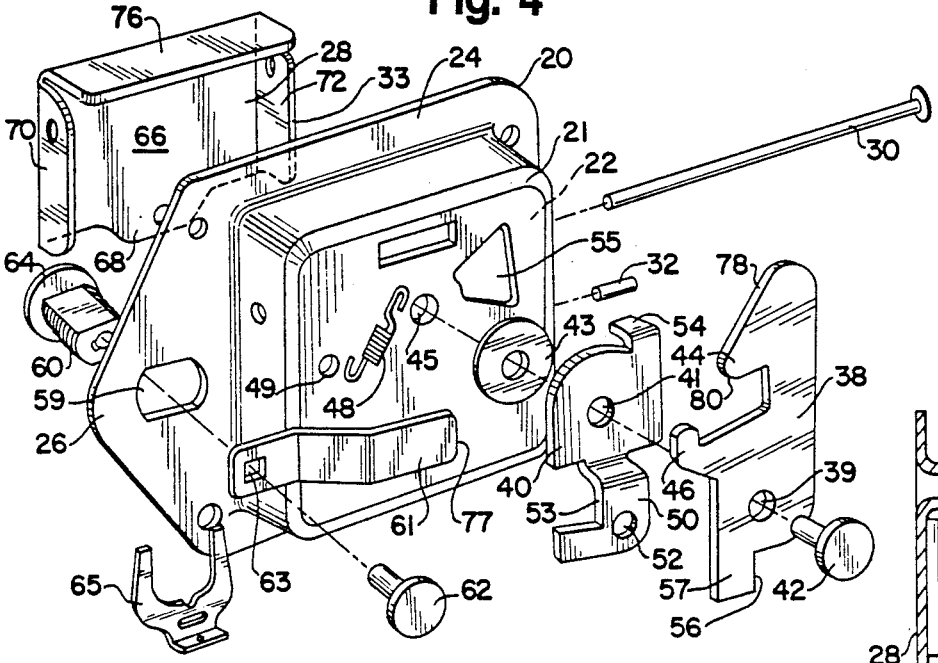
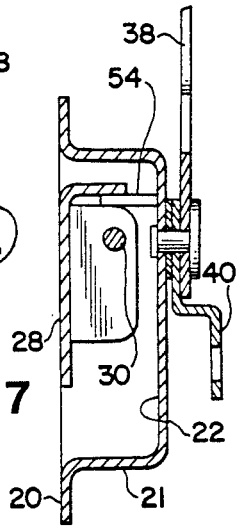
Fig. 7
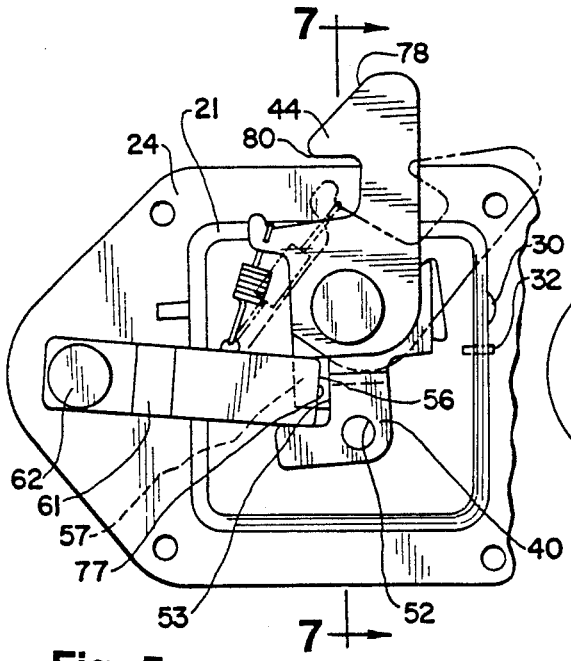
Fig. 5
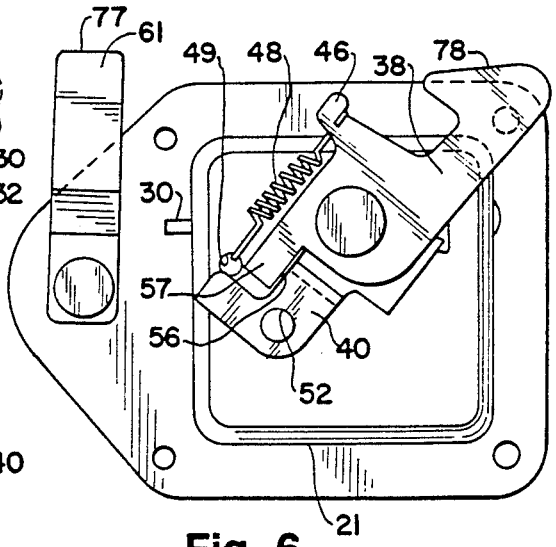
Fig. 6

PADDLE LATCH ASSEMBLY

TECHNICAL FIELD

The present invention relates to a latch mechanism for securing a movable closure as on a storage receptacle and, more particularly, to a latch mechanism that releasably engages a striker element on the closure to maintain the closure in a closed position.

BACKGROUND ART

Latch mechanisms having a rotatable latch element for engaging/disengaging a striker element are common, as seen, for example, in U.S. Pat. No. 4,438,964 to Peters. Such latch mechanisms typically include many moving parts to provide latched, unlatched, and locked positions. In order to provide the most simple and inexpensive manufacture of an assembly, it is desirable to minimize the number of parts therein.

Another problem with existing latch mechanisms is that it is often not possible to close a hinged closure element when the latching mechanism is inadvertently in a locked position. In some mechanisms, as the closure is moved towards a closed position, the striker element mounted on the cover is forced against a fixed rotary cam on the latch mechanism which may result in damage to both the striker and the latch mechanism.

In certain applications, it is also desirable to employ a number of independent latch mechanisms on a single storage container, as when the closure member is large or when there are a plurality of closure members. Such prior art arrangements generally require a user to successively actuate each of the mechanisms in order to open the cover(s) and gain access to the interior of the container and securely lock the container.

SUMMARY OF THE INVENTION

The present invention is specifically directed to overcoming the above enumerated problems in a novel and simple manner.

According to the invention, a latch assembly is provided for releasably securing a closure element with a striker element in a closed position. The latch assembly consists of a housing with a body, a release lever/member mounted for movement relative to the housing between (a) a normal position and (b) a release position; first and second latch elements mounted to the housing for movement relative to each other and the housing, with the first latched element being movable relative to the housing between a latched position in which it maintains the closure in its closed position and a release position in which the closure can be moved out of its closed position, and cooperating structure on the release lever and first and second latch elements for moving the second latch element relative to the housing and, in response thereto, causing the first latch element to move from its latched position to its release position as an incident of the release lever moving from its normal position to its release position.

The invention also contemplates a locking arm that is movable relative to the housing between locked and unlocked positions. The locking arm cooperates with the second latch element to block the movement of the second latch element relative to the housing with the locking arm in its locked position to thereby prevent movement of the first latch member from its latched position to its release position through the release lever.

With the above structure, it is possible to close the closure element and thereby lock and latch the closure element with the locking arm in its locked position. This is permitted by reason of the first latch element being movable relative to the second latch element and housing.

Preferably, the first latch element is biased towards its latched position. A camming structure is provided on the first latch element and cooperates with the striker element on the closure so that the striker element progressively cams the first latch element from its latched position towards its release position. Upon the closure element being closed, the first latch element, under the bias force, springs back to its locked position. This structure obviates the user's having to unlock and then re-lock the locking arm.

In a preferred form, the biasing structure consists of a coil spring with its ends attached to the first latch member and the housing.

To afford a compact configuration for the paddle latch, the housing has a body defining a recess and a peripheral flange which facilitates its attachment to a receptacle having the associated closure. The release member is mounted for pivoting movement at least partially within the recess and preferably supported for rotation by a pin extending through facing wall pairs on the body. The second latch element has a lever arm which projects from the rear of the body through a wall thereon and into the recess for engagement by the paddle/release member.

In a preferred form, the first and second latch elements are rotatable relative to each other and the housing about a common axis. Assembly is effected preferably through the use of a rivet or the like. The rivet supports the latch elements for rotation about an axis that is preferably perpendicular to the pivot axis for the paddle/release member.

Preferably, a cut-out is provided in the housing body to accept the lever arm and is so configured that the edge of the cut-out abuts the lever arm and limits the rotation of the second lever arm between first and second positions.

With the second latch element in its first position and the first latch element in its latched position, shoulders on the first and second latch elements abut. As the paddle/release member pivots from its normal position to its release position, the second latch element is pivoted to bear the shoulder thereon against the shoulder on the first latch element to resultingly move the first latch element from its latched position to its release position.

The invention also contemplates interconnecting a plurality of the latch assemblies to permit concurrent operation through any of the interconnected latch assemblies. In a preferred form, the second latch elements are interconnected through a linkage rod. Pivoting of the second latch element on any of the latch assemblies effects a corresponding movement of the latch assemblies interconnected by the linkage rod. This is a particularly desirable feature on long receptacles and on receptacles on which there are a plurality of latch assemblies.

BRIEF DESCRIPTION OF THE DRAWINGS

FIG. 1 is a perspective view of a cross-bed tool box having a paddle latch assembly embodying the present invention thereon;

FIG. 2 is a perspective view illustrating a tool box incorporating two interconnected latch assemblies according to the present invention;

FIG. 3 is a rear perspective view of a paddle latch assembly embodying the present invention in an assembled configuration;

FIG. 4 is an exploded rear perspective view of the paddle latch assembly of FIG. 3;

FIG. 5 is a rear view of the assembly shown in FIG. 3 with a latch element thereon shown in a locked position in solid lines and in a release position in phantom and with a locking arm for the latch assembly in a locked position;

FIG. 6 is a rear view as in FIG. 5 with the latch element and locking arm in an unlocked position; and FIG. 7 is a cross-sectional view of the inventive latch assembly taken along line 7—7 of FIG. 5.

DETAILED DESCRIPTION OF THE PREFERRED EMBODIMENT

FIG. 1 shows a cross-bed tool box generally at 10, having a paddle latch assembly 12, embodying the features of the present invention, with a receptacle portion 14 and a hinged closure/cover 16 having a depending striker element 18 thereon. As shown in FIGS. 3 and 4, the paddle latch 12 includes a housing 20 with a rectangular body 21 defining a cup-shaped recess 22 and having a peripheral mounting flange 24 with an enlarged portion 26 and a plurality of mounting holes 27 through the flange 24 for accepting screws, or the like, to fix the latch assembly 12 to the receptacle 14 of the tool box 10. A rectangular paddle/release member/lever 28 is mounted for rotation within the recess 22 about a hinge pin 30 extending through opposite walls of the body 21. A second pin 32, directed parallel to the hinge pin 30, extends through one wall of the recess 22 and abuts an edge 33 on the paddle/release member 28 to thereby limit rotation of the paddle/release member 28 into the recess 22.

A pair of rotary cams/latch elements 38, 40 are pivotably connected at the rear face of the housing 21 by means of a rivet 42 and a spacer washer 43. The rivet 42 passes successively through an opening 39 in the cam/-latch element 38, an opening 41 in the cam/latch element 40, the washer 43, and opening 45 in the housing 20 and is suitably anchored to the housing 20. The cam/latch element 38 has a hooked end 44 for engaging the striker 18 and a projecting finger 46. Rotary cam/-latch element 40 includes a depending leg 50 with a circular aperture 52 and an upper offset lever arm 54 projecting through an opening 55 in the housing 20. With the latch mechanism 12 assembled, as in FIG. 3, a shoulder 53 on the leg portion 50 of the rotary cam/-latch element 40 abuts a confronting shoulder 56 on the rotary cam/latching element 38, thereby interengaging the cams/latching elements 38, 40 to cause the cam/-latch element 38 to follow the cam/latch element 40 in an unlatching pivoting direction about the rivet 42 indicated by arrow A in FIG. 3, i.e. in a clockwise direction. The cam/latch element 38 has a depending tab 57 on which the shoulder 56 is defined. A coil spring 48 is connected between the finger 46 on the cam/latch element 38 and the edge of an opening 49 through the rear face of the rectangular body 21 and acts to rotationally bias the cam/latch element 38 and interengaged cam 40 in a counterclockwise direction as viewed in FIGS. 3 and 4.

A key lock 58 is mounted on the housing 20 and passes through an opening 59 on the enlarged flange portion 26. The key lock 58 and opening 59 have matched, non-circular cross sections to prevent rotation of the key lock 58 within the opening 59. The key lock 58 has a grooved lock cylinder 60 with a rotatable locking lever/arm 61 keyed to one end thereof by means of a fastener 62 and keyway 63 in the locking lever/arm 61. The key lock 58 is retained on the housing 20 by captively clamping the flange 24 between an enlarged head portion 64 on the lock 58 on one side of the housing 20 and a U-shaped retaining clip 65 on the other side of the housing 20. The clip 65 straddles the lock 58 and locks in mesh with threads thereon.

The paddle/release member 28 has a front face 66 defining a graspable handle 68, a pair of spaced sidewalls 70,72 for engaging the hinge pin 30, and a top wall/flange 76. The pin 30 guides movement of the paddle/release member 28 between a normal position, shown in solid lines in FIG. 7, and a release position, shown in phantom in FIG. 7. In operation, the flange 76 engages the lever arm 54 of the rotary cam/latch element 40 projecting through the opening 55 in the housing 20. As a rotative force is applied to the handle 68, the paddle/release member 28 is rotated about the hinge pin 30, with the flange 76 forcing the lever arm 54 downwardly and thereby rotating the rotary cam 40 about the pivot 42 from a first position, shown in FIG. 5, to a second position, shown in, FIG. 6. Due to the engagement of the shoulders 56, 53 on the cams/latch elements 38, 40, rotation of the cam/latch element 40 induced by actuation of the paddle 28 results in rotation of the cam 38 from a latched position, shown in FIG. 5, to a release position, shown in FIG. 6, to thereby disengage the hooked end 44 of the cam/latch element 38 from the striker element 18. The closure/cover 16 of the tool box 10 is thereby unsecured and may be opened.

It should be understood that in disengaging the mechanism, a restoring force is continuously applied to the cam/latch element 38 by the spring 48. As the cam/-latch element 38 is rotated out of engagement with the striker 18, the spring 48 is extended and acts to apply a restoring force to the cam/latch element 38. Once the handle 68 is released to its normal position, the spring 48 acts to rotate the interengaged cams/latch elements 38,40 in a counterclockwise direction in FIGS. 3-6, with the lever arm 54 thereby moving upwards and against the flange 76 to cause the lever arm 54 to rotate into contact with the pin 32.

The locking lever/arm 61 of the key lock 58 may be rotated by actuation of an external key (not shown) between a locked position in FIG. 5, wherein a shoulder on the free end 77 of the locking lever/arm 61 confronts the leg 50 of the rotatable cam/latch element 40 and thereby blocks the path of the cam/latch element 40 from its first towards its second position, and an unlocked position in FIG. 6. When one attempts to actuate the handle 68 of the paddle/release member 20 with the locking lever/arm 61 in its locked position, the flange 76 of the paddle/release member 28 abuts the lever arm 54 of the fixed cam/latch element 40 to arrest rotation of the paddle/release member 28 about the hinge pin 30. In order to disengage the hooked end 44 of the cam/latch element 38 from the striker element 18, it is necessary to rotate the locking lever/arm 61 out of its locked position to thereby allow the paddle/release member 28 to rotate and effectuate rotation of the interengaged cams/latching elements 38,40 (see FIG. 6).

Because the cam/latch element 38 is normally biased towards its latched position, it is possible to close and latch an opened closure/cover 16 without using the paddle/release member 28. As the closure/cover 16 is moved downwardly the striker element 18 is forced against a tapered surface 78 on the hooked end 44 on the cam/latch element 38. As the striker element 18 is moved downward and into contact with the surface 78, the cam/latch element 38 is forcibly rotated in a clockwise direction and the spring 48 is extended. Once the striker element 18 passes the bottom edge 80 of the tapered surface 78, the hooked end 44 is rapidly rotated in a counterclockwise direction and into engagement with the striker element 18 under the force applied by the spring 48.

Due to the manner in which the cam/latch element 38 and cam/latch element 40 are interengaged, it is possible to forcibly engage the hooked end 44 of the cam/latch element 38 with the striker element 18 as previously described without inducing rotation of the cam/latch element 40. As the cam/latch element 38 rotates in a clockwise direction, the shoulder 56 on the cam/latch element 38 moves out of engagement with the leg 50 of the cam/latch element 40 with the locking lever/arm 61 in its locked position. This configuration is illustrated in phantom in FIG. 5. This is a particularly useful feature in that it permits one to lock the closure/-cover 16 of the tool box 10 with the looking lever/arm 61 already in a locked position without having to use a key to unlock and then re-lock the locking lever/arm 61. With the locking lever/arm 61 engaging the leg 50 and thereby precluding rotation of the cam/latch element 40, the self-latching/locking capability of the mechanism would not be possible if the cams/latch elements 38,40 were not independently rotatable.

In FIG. 2, a pair of paddle latch assemblies **12*a*,12*b* are shown interconnected by a linkage rod 82. This configuration is particularly useful in applications wherein a storage receptacle 11 has a sufficient width requiring securement of a hinged cover (not shown) at a number of points, or alternatively having a plurality of covers. Further, it is desirable to have the capability of disengaging and/or locking each of the paddle latch assemblies, 12*a*, 12*b*** remotely from either of the interconnected assemblies. It should be understood that while the present disclosure illustrates an application having only two interconnected assemblies, this disclosure envisions other embodiments having any number of interconnected assemblies.

Each of the latch assemblies **12*a*,12*b* preferably conforms exactly to that described above, with the exception that one of the latch assemblies, arbitrarily 12*a*, does not need a key lock. The linkage rod 82 has curved ends 84,86, which are received by the circular apertures 52 extending through the legs 50 of the rotary cams/-latching elements 40 in each mechanism. With this simple construction, it can be seen that actuation of either of the latch mechanisms 12*a*,12*b* through rotation of the paddle/release member 28 on either of the mechanisms effects disengagement of the hooked ends 44 of each of the mechanisms from corresponding striker elements (not shown) on the cover (not shown). In a manner analogous to that described above, as the paddle/release member 28 of one of the mechanisms 12*a*,12*b* is rotated about its hinge pin 30, the flange 76 engages the lever arm 54 of the rotary cam/latch element 38 and induces clockwise rotation of the two cams/latch elements 38,40. Because the cams/latch elements 38 of each of the mechanisms 12*a*,12*b* are linked by means of the rod 82, rotation of the cam/latch element 40 at latch mechanism 12*a* forces rotation of cam/latch element 40 at latch mechanism 12*b*. Opposite rotation of each of the cams/latch elements 40 results in rotation of each of the cams/latch elements 38 to disengage the hooked ends 44 of each of the mechanism 12*a*,12*b*** from their respective strikers and releases the cover.

It is also possible with this construction to prevent both of the mechanisms **12*a*,12*b* from being disengaged by locking only one mechanism, say 12*b*. When the locking lever/arm 61 of mechanism 12*b* is rotated into engagement with the leg 50 of the rotary cam/latch element 40, as described above, the leg 50 is prevented from rotating in a direction operable to disengage the hooked end 44 of the cam/latch element 38. Because the cam/latch element 38 of mechanism 12*b* is fixed, and the cams 40 are dependently linked by the rod 82, the cam/-latch element 40 of latch mechanism 12*a* is similarly prevented from rotating. By unlocking mechanism 12*b*, the cams/latching elements 40** of each of the latch assemblies is free to rotate.

The self-latching feature of the latch assemblies **12*a*,12*b* is particularly useful in the coupled embodiment illustrated in FIG. 2. Because of the typically flexible construction of the hinged covers of commonly known tool boxes, shutting the cover from one location often results in flexing of the cover such that only one of the striker elements engages a latch assembly. In order to secure the disengaged striker, an operator must force that portion of the cover downward such that the striker element engages the hooked end of the corresponding latch assembly. If it were not possible for the cam/latch element 38 to rotate independently of the cam/latch element 40, in order to secure the unengaged striker, it would be necessary to actuate the paddle/-release member of that latch assembly to rotate the cams/latch elements and thereby engage the striker. The problem with this is that by rotating the cam/latch element 40, the previously engaged mechanism is also actuated by the linkage rod 82. By forcing the unsecured striker into engagement with the now opened latch, the cover may flex and thereby disengage the previously secured striker from the opposite latch. By allowing the cam/latch element 40 to rotate independently of the cam/latch element 38**, it is possible to latch the coupled assemblies one at a time and engage an unsecured portion of the cover without inducing disengagement of the already engaged portion.

The foregoing disclosure of specific embodiments is intended to be illustrative of the broad concepts comprehended by the invention.

We claim:

1. A latch assembly for releasably securing a closure element having a striker element in a closed position, said latch assembly comprising:

a housing with a body;

a release lever;

means for mounting the release lever for movement relative to the housing between (a) a normal position and (b) a release position;

first and second latch elements, said first latch element having a hooked end portion for engaging the striker element for maintaining the closure element in its closed position;

means for mounting the first and second latch elements to the housing for movement relative to each other and the housing, said first latch element being movable relative to the housing between (a) a latched position in which it maintains the closure in its closed position and (b) a release position in which the closure can be moved out of its closed position, there being cooperating means on the release lever and first and second latch elements for moving the second latch element relative to the housing and, in response thereto, causing the first latch element to move from its latched position to its release position as an incident of the release lever moving from its normal position to its release position;

a locking arm; and means for mounting the locking arm to the housing for movement relative to the housing between (a) a locked position and (b) an unlocked position, there being cooperating means on the locking arm and second latch element for blocking movement of the second latch element relative to the housing with the locking arm in its locked position to thereby prevent movement of the first latch element from its latched position to its release position through the release lever, said first element being movable from its latched position to its release position with the locking arm situated to block movement of the second latch element from its first position.

2. The latch assembly according to claim 1 wherein the housing has an opening, the second latch element has a lever arm projecting through the housing opening with a free end thereof being engageable with the release lever within the recess and movable in response to movement of the release lever.

3. The latch assembly according to claim 2 wherein the housing has an edge which bounds the housing opening and limits movement of the lever arm and thus the second latch element relative to the housing.

4. A latch assembly for releasably securing a closure element having a striker element in a closed position, said latch assembly comprising:

a housing with a body;

a release lever;

means for mounting the release lever for movement relative to the housing between (a) a normal position and (b) a release position;

first and second latch elements, said first latch element having means for engaging the striker element for maintaining the closure element in its closed position; and means for mounting the first and second latch elements to the housing for movement relative to each other and the housing, said first latch element being movable relative to the housing between (a) a latched position in which it maintains the closure in its closed position and (b) a release position in which the closure can be moved out of its closed position, there being cooperating means on the release lever and first and second latch elements for moving the second latch element relative to the housing and, in response thereto, causing the first latch element to move from its latched position to its release position as an incident of the release lever moving from its normal position to its release position, wherein the latch element mounting means comprises means for mounting the latch elements for rotation about a common axis relative to the housing.

5. The latch assembly according to claim 1 wherein at least one of said latch elements is mounted for rotation relative to the housing.

6. The latch assembly according to claim 1 wherein means are provided for biasing the first latch element towards its latched position.

7. The latch assembly according to claim 6 wherein the biasing means comprises a coil spring.

8. The latch assembly according to claim 4 wherein the release lever is movable between its normal and release positions about an axis that is transverse to said common axis.

9. The latch assembly according to claim 1 wherein said cooperating means includes a shoulder on each of the first and second latch elements, said shoulder on the second latch element engaging the shoulder on the first latch element to move the first latch element from its latched position to its release position as the release lever is moved from its normal position to its open position.

10. The latch assembly according to claim 9 in combination with a closure that is movable between open and closed positions and carrying said striker element, wherein the first latch element has a cam surface which cooperates with the striker element, said striker element progressively urging the first latch element from its latched position towards its release position as an incident of the closure moving from its open to its closed position.

11. A latch assembly for releasably securing a closure element having a striker element in a closed position, said latch assembly comprising:

a housing with a body;

a release lever;

means for mounting the release lever for movement relative to the housing between (a) a normal position and (b) a release position;

first and second latch elements, said first latch element having means for engaging the striker element for maintaining the closure element in its closed position; and means for mounting the first and second latch elements to the housing for movement relative to each other and the housing, said first latch element being movable relative to the housing between (a) a latched position in which it maintains the closure in its closed position and (b) a release position in which the closure can be moved out of its closed position, there being cooperating means on the release lever and first and second latch elements for moving the second latch element relative to the housing and, in response thereto, causing the first latch element to move from its latched position to its release position as an incident of the release lever moving from its normal position to its release position, wherein said cooperating means includes a shoulder on each of the first and second latch elements, said shoulder on the second latch element engaging the shoulder on the first latch element to move the first latch element from its latched position to its release position as the release lever is moved from its normal position to its open position;

a closure that is movable between open and closed positions and carrying said striker element, wherein the first latch element has a cam surface which cooperates with the striker element, said striker element progressively urging the first latch element from its latched position towards its release position as an incident of the closure moving from its open to its closed position; and a movable locking arm for selectively blocking movement of the second latch element, wherein with the locking arm situated to block movement of the second latch element from its first position, the first latch element is movable from its latched position to its release position.

12. The latch assembly according to claim 1 wherein there are first and second latch assemblies as claimed in claim 1 and including means for interconnecting the first and second latch assemblies so that movement of the first latch element by the second latch element from its latched position to its release position on one of the latch assemblies effects a like movement of the first latch element on the other of the latch assemblies.

13. The latch assembly according to claim 12 wherein the interconnecting means interconnects the second latch of each latch assembly elements to each other.

14. The latch assembly according to claim 1 wherein said housing body defines a recess and the release lever mounting means mounts the release lever at least partially within the housing body recess.

15. A latch assembly for releasably securing a closure element having a striker element in a closed position, said latch assembly comprising:

a housing;

a release lever;

means for mounting the release lever for movement relative to the housing between (a) a normal position and (b) a release position;

first and second latch elements, said first latch element having a hooked end portion for engaging the striker element for maintaining the closure element in its closed position; and means for mounting the first and second latch elements to the housing for pivoting movement about substantially parallel axes relative to each other and the housing, said first latch element being movable relative to the housing between (a) a latched position in which it maintains the closure in its closed position and (b) a release position in which the closure can be moved out of its closed position, there being cooperating means on the release lever and first and second latch elements for causing the release lever to act directly against the second latch element to move the second latch element from a first position to a second position as the release lever moves from its normal position into its release position and for causing the second latch element to act directly against the first latch element and move the first latch element from its latched position into its release position as the second latch element moves from its first position to its second position.

16. A latch assembly for releasably securing a closure element having a striker element in a closed position, said latch assembly comprising:

a housing;

a release lever;

means for mounting the release lever for movement relative to the housing between (a) a normal position and (b) a release position;

first and second latch elements, said first latch element having a hooked end portion for engaging the striker element for maintaining the closure element in its closed position; and means for mounting the first and second latch elements to the housing for movement relative to each other and the housing, said first latch element being movable relative to the housing between (a) a latched position in which it maintains the closure in its closed position and (b) a release position in which the closure can be moved out of its closed position, there being cooperating means on the release lever and first and second latch elements for causing the release lever to act directly against the second latch element to move the second latch element from a first position to a second position as the release lever moves from its normal position into its release position and for causing the second latch element to act directly against the first latch element and move the first latch element from its latched position into its release position as the second latch element moves from its first position to its second position, wherein the cooperating means includes means for allowing the first latch element to move from its latched position to its release position without moving the second latch element from its second position to its first position.

17. The latch assembly according to claim 16 including means for selectively blocking the second latch element in its first position.

18. The latch assembly according to claim 17 wherein the blocking means comprises an arm that is pivotably attached to the housing for movement between a first clocking position wherein a shoulder on the blocking means arm confronts a part of the second latch element and a second position wherein the shoulder on the blocking means arm is moved away from the part of the second latch element.

* * * * *